US006598317B1

(12) United States Patent
Le Vine et al.

(10) Patent No.: US 6,598,317 B1
(45) Date of Patent: Jul. 29, 2003

(54) SHOE TAP PROTECTORS

(76) Inventors: Jan F. Le Vine, 21618 Los Alimos St., Chatsworth, CA (US) 91311; Riley M. Sopko, 455 Maple Ave., Torrence, CA (US) 90503

( * ) Notice: Subject to any disclaimer, the term of this patent is extended or adjusted under 35 U.S.C. 154(b) by 0 days.

(21) Appl. No.: 09/803,490

(22) Filed: May 21, 2001

Related U.S. Application Data

(60) Provisional application No. 60/247,419, filed on Nov. 13, 2000.

(51) Int. Cl.[7] ..... A43B 5/12
(52) U.S. Cl. ..... 36/8.3; 36/15
(58) Field of Search ..... 36/8.3, 15, 36 R, 36/41, 135, 42

(56) References Cited

U.S. PATENT DOCUMENTS

| | | | | | |
|---|---|---|---|---|---|
| 754,673 | A | * | 3/1904 | Mitchell | 36/135 |
| 1,557,393 | A | * | 10/1925 | Abrams | 36/15 |
| 2,205,344 | A | * | 6/1940 | Carrara | 36/113 |
| 3,007,260 | A | * | 11/1961 | Stone | 36/113 |
| 4,351,120 | A | * | 9/1982 | Dalebout | 36/117.3 |
| 4,463,506 | A | * | 8/1984 | Isackson | 36/113 |
| 5,007,185 | A | * | 4/1991 | Lazarski | 36/131 |
| 5,459,946 | A | * | 10/1995 | Rayow | 36/113 |
| 6,092,306 | A | * | 7/2000 | Newton-Dunn | 36/135 |

* cited by examiner

*Primary Examiner*—Ted Kavanaugh
(74) *Attorney, Agent, or Firm*—Robert M. Sperry, Esq.

(57) ABSTRACT

Removable tap covers for dancing shoes which can quickly and easily be placed on the taps to prevent accumulation of dirt and grime in the taps, yet which can quickly and easily be removed to allow the full effect of the taps for dancing.

11 Claims, 6 Drawing Sheets

SHOE TAP PROTECTORS

This application claims benefit of U.S. Provisional Application No. 60/247,419 filed Nov. 13, 2000.

FIELD OF INVENTION

This invention relates to dancing shoes and is particularly directed to means for protecting shoe taps for scratching floors and the like and from becoming fouled with dirt.

PRIOR ART

As is well known, dancers have been attaching metal taps to shoes for many years to enhance the sound produced when the dancer's foot touches the surface upon which they are dancing. Usually, this surface will be a wooden stage or floor. Unfortunately, since the metal taps are harder than the floor, the taps frequently cause scratching of the floor, especially when the dancer is walking, rather than dancing, since, in walking, the feet tend to slide horizontally, rather than move vertically, as in dancing. Furthermore, as the taps move along the floor, they tend to accumulate dirt and other debris which reduces the effectiveness of the taps and necessitates cleaning and, eventually, replacement of the taps. This is time-consuming and expensive. Unfortunately, no means has been provided heretofore for overcoming this problem. Thus, none of the prior art tap shoes have been entirely satisfactory.

BRIEF SUMMARY AND OBJECTS OF INVENTION

These disadvantages of the prior art are overcome with the present invention and means are provided for preventing dirt and grime from accumulating in the taps and which preclude scratching of the floor, yet which can quickly and easily be removed to allow the full effect of the taps for dancing.

These advantages of the present invention are preferably attained by providing removable tap covers for dancing shoes which can quickly and easily be placed on the taps to prevent accumulation of dirt and grime in the taps, yet which can quickly and easily be removed to allow the full effect of the taps for dancing.

Accordingly, it is an object of the present invention to provide improved tap dancing shoes.

Another object of the present invention is to provide removable tap covers which can quickly and easily be applied to prevent dirt and grime from accumulating in the taps when the dancer is walking about.

An additional object of the present invention is to provide removable tap cover which can preclude the taps from scratching the floor when the dancer is walking about.

A further object of the present invention is to provide removable tap covers which Can quickly and easily be removed to allow the full effect of the taps during dancing.

A specific object of the present invention is to provide removable tap covers for dancing shoes which can quickly and easily be placed on the taps to prevent accumulation of dirt and grime in the taps, yet which can quickly and easily be removed to allow the full effect of the taps for dancing.

These and other objects and features of the present invention will be apparent from the following detailed description, taken with reference to the figures of the accompanying drawing.

DETAILED DESCRIPTION OF THE INVENTION

Figures 1, 1A:
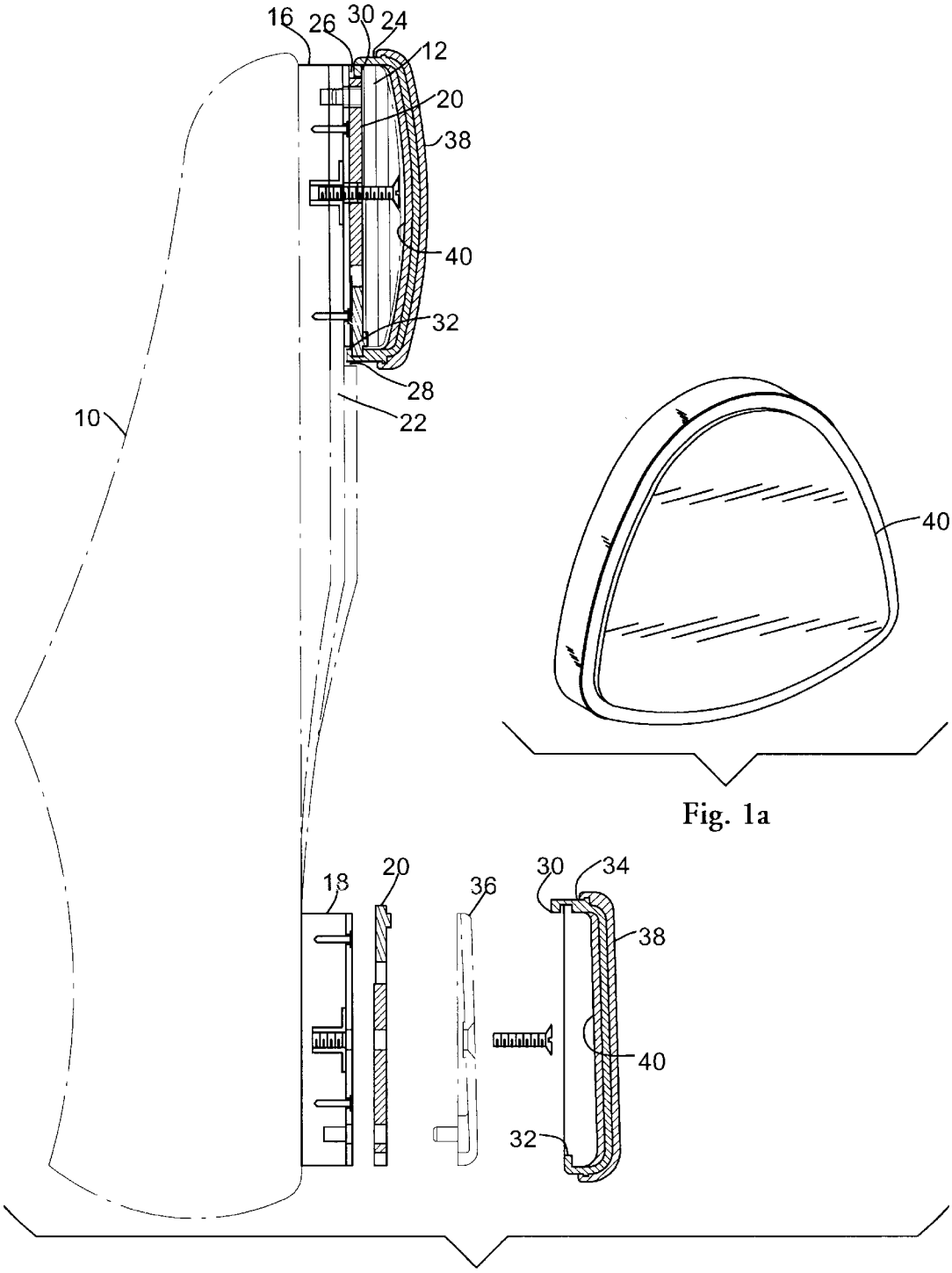
FIG. 1 is a side view, partly in phantom and partly exploded, showing the tap covers of the present invention applied to a dancing shoe.
FIG. 1A is an isometric bottom view showing the tap cover attached to the toe tap of the dancing shoe of FIG. 1.
Figure 2:
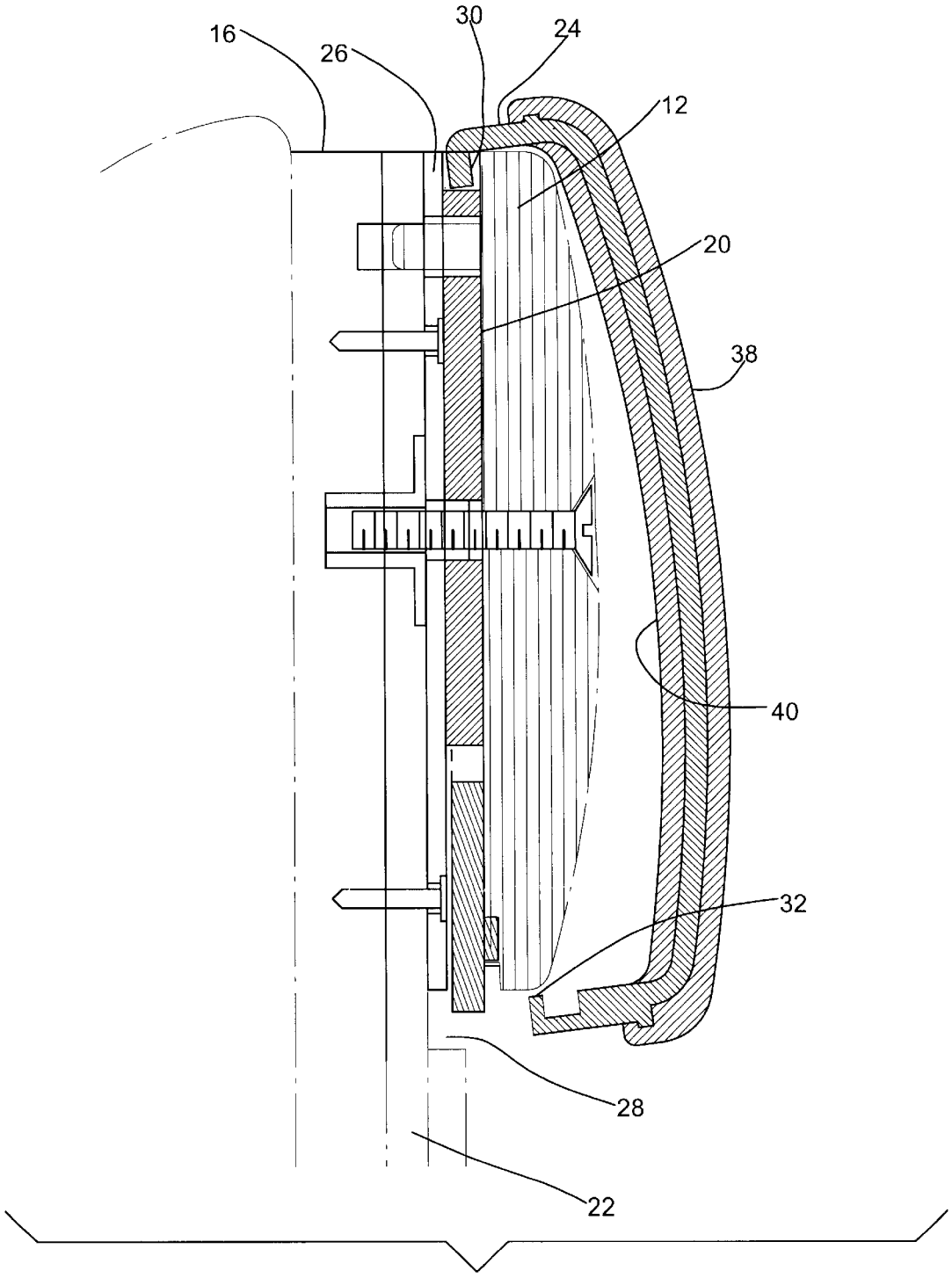
FIG. 2 is an enlarged side view showing the tap cover of FIG. 1 being applied to a tap.
Figure 3A:
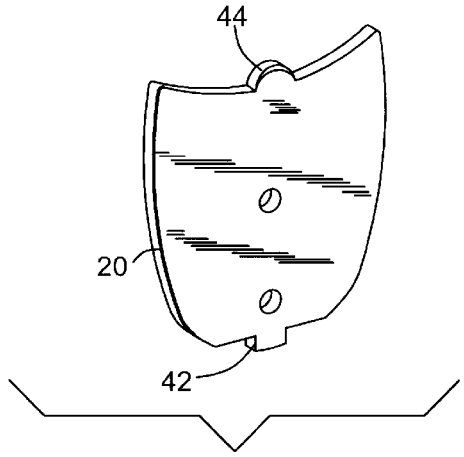
FIG. 3A is an isometric view showing the spacer plate of the tap cover of FIG. 1.

In that form of the present invention chosen for illustration in FIG. 1, a dancing shoe, shown in phantom and indicated generally at 10, is shown having taps 12 and 36 mounted on the toe 16 and heel 18 of the shoe 10. A spacer plate 20, as seen in FIG. 3A, is inserted between the tap 12 and the sole 22 of the shoe 10 and is slightly smaller in area than the tap 12 so as to provide spaces 26 and 28 adjacent the edges of the tap 12. The tap cover 24 is preferably composed of two or more layers; an inner layer 24 (See FIG. 6) and additional layers 38 and 40, and is formed with inwardly turned edges 30 and 32 and is releasably attached by inserting the edges 30 and 32 into the spaces 26 and 28, as seen in FIGS. 1 and 2. The tap cover inner structure 24 is formed of resilient plastic, so that it can flex to allow the edges 30 and 32 to pass about the tap 12 and to snap back into the spaces 26 and 28 to attach the tap cover 24 to the tap 12. The tap cover 38 is also formed of a suitable plastic which will not slip on smooth floors, but will provide a firm grip to prevent the dancer from sliding. A similar tap cover 34 is releasably attachable to the heel tap 36 in the same manner as described for the toe tap cover 24. If desired, additional layers 38 and 40 of material may be applied inside and outside of the tap cover inner structure 24. The outer layer 38 may be formed of rubber or a relatively high friction plastic to provide greater traction for the tap covers 24 and 34, when the dancer is walking about. The inner layer 40 is preferably formed of a hard plastic which will provide a strong sharp tapping sound when the dancer is dancing with the tap covers 24 and 34 attached, as in a school or practice session in a gymnasium or other non-stage location.

In use, the dancer places the tap cover 24 on the toe tap 12 and presses the center of the tap cover 24 inwardly. This causes the edges of the tap cover to spread, whereupon the dancer grasps the edges 30 and 32 of the tap cover 24 and pulls them about the tap 12 until the edges 30 and 32 can be inserted into the spaces 26 and 28 between the tap 12 and spacer plate 20. The dancer then releases the tap cover 24, which resiliently springs into place and releasably attaches the tap cover 24 to the tap 12. Heel tap cover 34 is attached to.heel tap 36 in the same manner. Thereafter, the dancer can walk about freely without concern for scratching the floor or getting dirt or grime into the tap 12. When the dancers are ready to dance, they simply press the center of the tap cover 24 inwardly, causing the tap cover 24 to spread until the dancer can grasp the edges 30 and 32 of the tap cover 24 to remove the tap cover. Thereafter, the dancer can dance and obtain the full effect of the taps 12 and 36.

Figure 3:
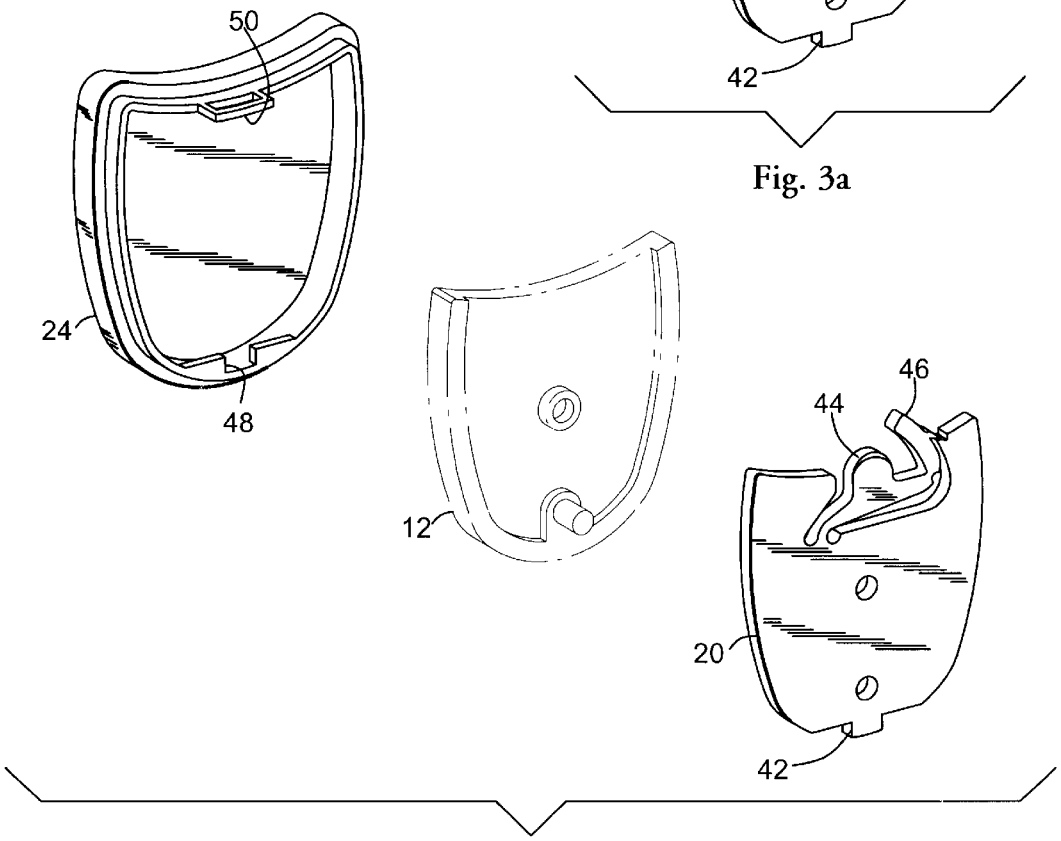
FIG. 3 is an exploded view showing an alternative form of the tap cover of FIG. 1.

FIG. 3 shows an alternative form of the spacer plate 20 formed with a stud 42 at one end and a resilient arm 44 connected to a lever 46 adjacent the other end. The tap cover 24 is formed with a loop 48 at one end and a generally U-shaped flanged member 50 projecting at a right angle to the tap cover 24 adjacent the opposite end. Heel tap cover 34 and the heel spacer plate 20 can be similarly modified. In use, the dancer inserts stud 42 of the spacer plate 20 into the loop 48 of the tap cover 24. Next the dancer presses inwardly on the lever 46 to drive the resilient arm 44 inward and places the flanged member 50 in position. Finally, the dancer releases lever 46 which allows the resilient arm 44 to enter the U-shaped member 50 and to releasably attach the tap cover 24 to the tap shoe 10. The dancer can then walk about freely without concern about scratching the floor or fouling the taps 12 and 36. To remove the tap covers 24 and 34, the dancer simply presses inwardly on lever 46 to drive the resilient arm 44 out of engagement with the U-shaped member 50 and removes the tap cover 24.

Figure 4:
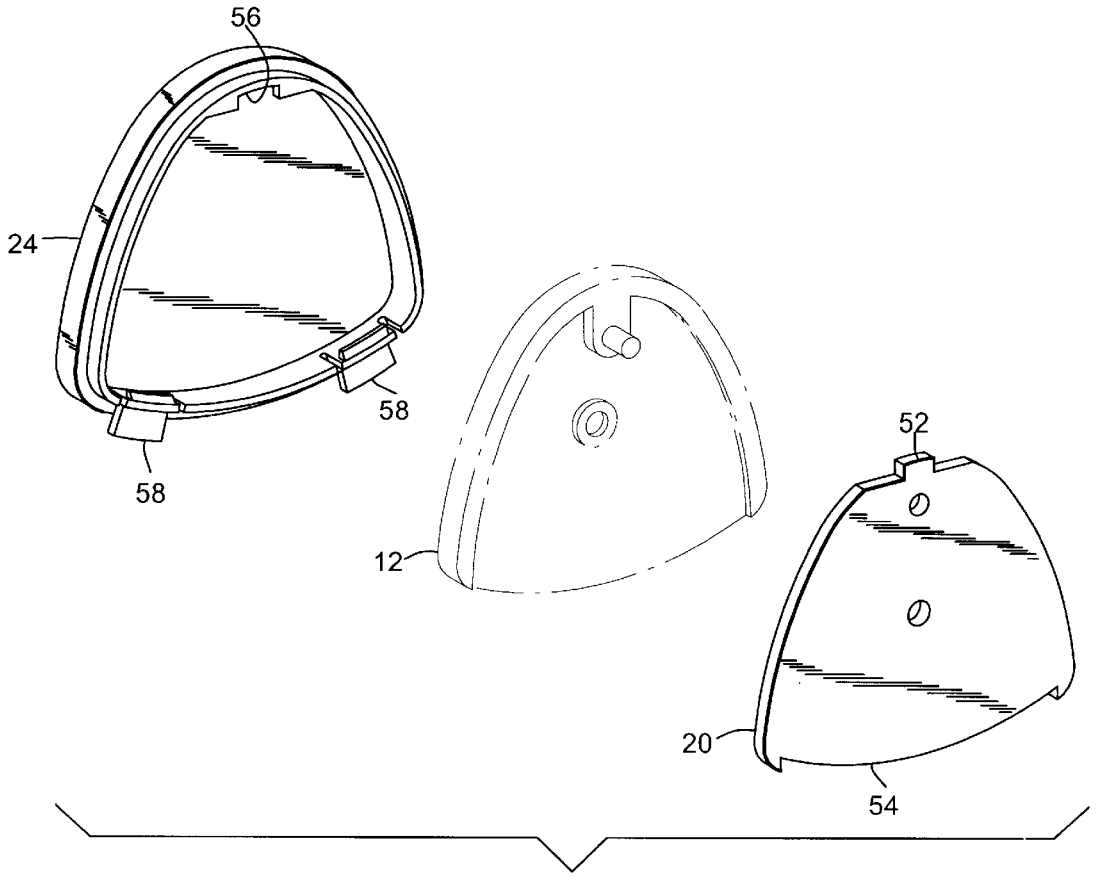
FIG. 4 is an exploded view showing another alternative form of the tap cover of FIG. 1.

FIG. 4 shows another alternative form of the spacer plate 20 and tap cover 24. In this form, the spacer plate 20 is formed with a stud 52 projecting from one end thereof and has a recess 54 formed in the opposite end. The tap cover 24 is formed with a recess 56 adjacent one end and is provided with one or more resilient latch members 58 on the opposite end. In use, the dancer inserts the stud 52 into the recess 56 and snaps the latch members 58 into the recess 54 of the spacer plate 20 to releasably attach the tap cover 24 to the tap shoe 10. To remove the tap cover 24, the dancer lifts on the latch members 58 to cause them to withdraw from recess 54 and slips recess 56 off of stud 52. The tap cover 24 is then separated from the tap shoe 10.

Figure 5:
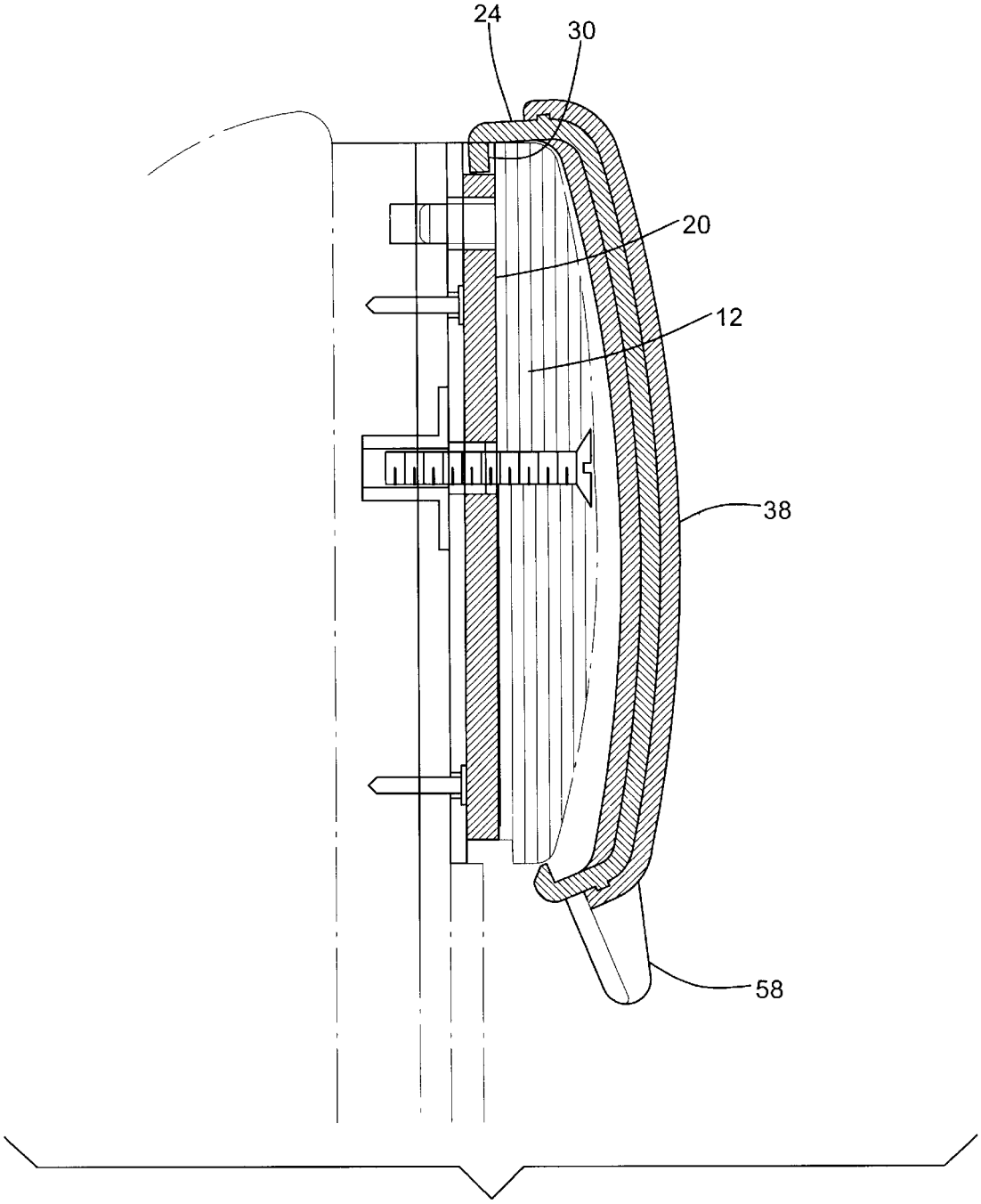
FIG. 5 is a view similar to that of FIG. 2, showing a further alternative form of the tap cover of FIG. 1.

FIG. 5 shows a further alternative form of the tap cover 24 of FIG. 1, having a tab 58 attached to the exterior surface of the tap cover 24 to facilitate applying and removing the cover 24.

Figure 6:
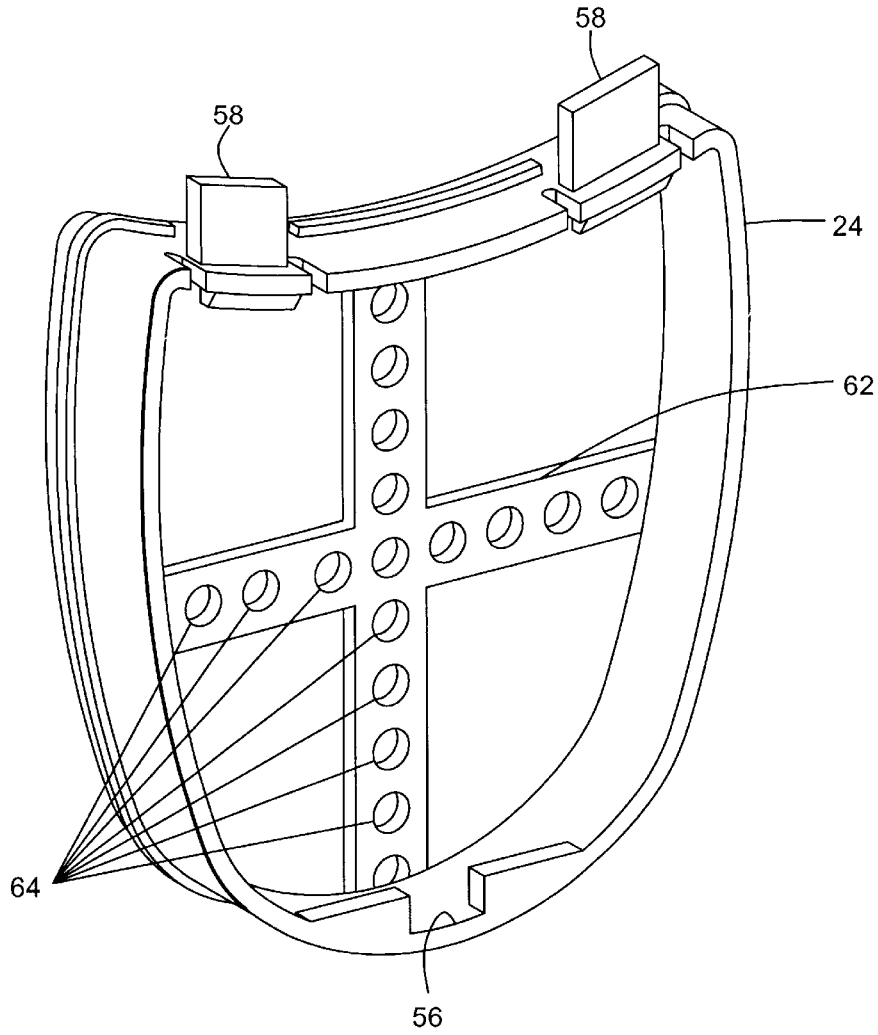
FIG. 6 is an isometric view showing the framework for the tap cover of the present invention.

FIG. 6 shows the inner structure of the tap cover 24 having a framework 62 formed of rigid material, such as metal or plastic, extending across the interior of the tap cover 24. The framework 62 is formed with a plurality of openings 64 which receive the plastic of the tap cover 24 during the forming process and serve to provide a stronger structure for the tap cover 24.

Obviously, numerous other variations and modifications can be made without departing from the spirit of the present invention. Therefore, it should be clearly understood that the forms of the present invention described above and shown in the figures of the accompanying drawing are illustrative only and are not intended to limit the scope of the present invention.

What is claimed is:

1. An improved tap dancing shoe comprising:

a dancing shoe having taps on the toe and heel of said shoe, tap covers removably mounted on said taps, spacer plates mounted between said taps and said shoe;

said spacer plates are slightly smaller than said taps to provide spaces about the periphery thereof between said taps and said shoe, and said tap covers are formed with means insertable into said spaces to releasably attach said tap covers to said taps.

2. The tap shoe of claim 1 wherein:

said tap covers are formed of resilient plastic.

3. The tap shoe of claim 1 herein:

said insertable means are latch members resiliently mounted on said tap cover.

4. The tap shoe of claim 1 herein:

said spacer plate has a stud projecting from one end thereof, and said tap cover is formed with a U-shaped member releasably engageable with said stud to releasably attach said tap cover to said shoe.

5. The tap shoe of claim 1 wherein:

said tap covers are formed with an additional layer applied to the outer surface of said cover formed of relatively high friction material.

6. The tap shoe of claim 1 wherein:

said tap covers are formed with an additional layer applied to the inner surface of said tap cover and formed of hard, rigid material.

7. The tap shoe of claim 1 wherein:

said tap covers are formed with a rigid framework extending across the interior of said tap covers.

8. The tap shoe of claim 7 wherein:

said framework is formed of metal.

9. The tap shoe of claim 7 wherein:

said framework is formed with a plurality of openings to allow plastic to flow into said openings during forming of said tap cover.

10. An improved tap dancing shoe comprising:

a dancing shoe having taps on the toe and heel of said shoe, tap covers removably mounted on said taps, spacer plates mounted between said taps and said shoe;

said spacer plate is formed with a resilient arm having a lever member attached thereto, and said tap cover is formed with a U-shaped member releasably engageable by said arm to releasably attach said tap cover to said shoe.

11. A tap cover for a dancing shoe having taps, said cover comprising:

spacer plates mounted between said taps and said shoe, said spacer plates are slightly smaller than said taps to provide spaces about the periphery thereof between said taps and said shoe, said tap covers are formed with means insertable into said spaces to releasably attach said tap covers to said taps, said spacer plate is formed with a resilient arm having a lever member attached thereto, and said tap cover is formed with a U-shaped member releasably engageable by said arm to releasably attach said tap covers to said shoe.

* * * * *